United States Patent [19]

Houtz

[11] Patent Number: 4,900,030

[45] Date of Patent: Feb. 13, 1990

[54] PUTTING STROKE TRAINING DEVICE

[76] Inventor: Bradley L. Houtz, 1305 Park Pl., Marysville, Kans. 66508

[21] Appl. No.: 191,012

[22] Filed: May 6, 1988

[51] Int. Cl.[4] ..... A63B 69/36

[52] U.S. Cl. ..... 273/183 E; 273/187 R; 273/192

[58] Field of Search ..... 273/35 R, 32 R–32 C, 273/32 H, 183 R–183 B, 183 E, 186 R, 186 C, 187 R–187 B, 188 R–188 A, 186 C–186 D, 189 R, 191 R–191 B, 192, 195, 26 R; 272/101, 102; 434/252; 135/67

[56] References Cited

U.S. PATENT DOCUMENTS

| | | | |
|---|---|---|---|
| 3,332,688 | 7/1967 | Gevertz | 273/183 A |
| 3,583,707 | 6/1971 | Fujimoto et al. | 273/191 A |
| 3,953,035 | 5/1976 | Beckisk | 273/192 |
| 4,696,470 | 9/1987 | Fenner | 272/102 |
| 4,736,952 | 4/1988 | Taft et al. | 273/186 R |

*Primary Examiner*—Edward M. Coven

*Assistant Examiner*—Sebastiano Passaniti

*Attorney, Agent, or Firm*—Hovey, Williams, Timmons & Collins

[57] ABSTRACT

A device for improving putting strokes used by golfers includes a guide member which is spaced from the ground for sliding contact with the back side of a putter shaft. The guide member includes a straight section in regions overlying a target area of the ball, and also includes a curved rearward section so that the club swings through a natural pendulum motion during the back swing and down swing of the putting stroke. In preferred embodiments, the guide member is provided with a number of matched pairs of spaced apart indicia which may be visually observed by the golfer to ensure that the putting stroke is balanced and extends equal distances on opposite sides of the ball target area. Advantageously, the device is foldable to a collapsed, relatively small profile for transport or storage, and also may be set up in a reversed orientation for use by left-handed golfers.

5 Claims, 1 Drawing Sheet

PUTTING STROKE TRAINING DEVICE

BACKGROUND OF THE INVENTION

1. Field of the Invention

This invention relates to a device used by golfers for guiding a putter along a path such that the arms and club move with a natural pendulum motion. More particularly, the present invention concerns a collapsible training device which has a guide member spaced from the ground for engaging the back side of a putter shaft and for moving the putter along a path which includes a curved rear portion and a straight target portion.

2. Description of the Prior Art

In general, two types of putting strokes are in common use. One type of stroke is characterized by a quick, jabbing motion with relatively little back swing or follow-through once the ball has been hit. Another type of putting stroke may be described as a natural pendulum-type motion which is similar to a shortened variation of the common, full golf swing.

In the past, golfers have sometimes utilized a pair of straight boards for practicing the jabbing-type putting stroke. Typically, the boards are placed on the ground in parallel disposition relative to each other and spaced apart a distance slightly larger than the length or fore-to-aft measurement of the putter head. By repetitively swinging the putter in such a manner that the putter head follows along the space or channel between the two boards, the golfer after a period of time develops a memory or feel for the movement of the body muscles necessary for smoothly moving the putter head along a short, straight path of travel.

In recent years, increased interest has been directed toward the use of the pendulum type motion for putting. However, the aforementioned use of spaced apart, straight boards cannot be used as a training device for the pendulum-type swing since the head of the putter during the latter type of motion must move along a path which includes a curved portion as well as a straight portion so that the putter head stays at approximately the same distance from the body during all portions of the swing. Moreover, the head of the putter during the back swing of the longer pendulum-type motion may shift a substantial distance above the ground and consequently move above the top of the guiding boards normally used for practice of the short, jabbing putting stroke.

SUMMARY OF THE INVENTION

My present invention is directed toward a training device for improving pendulum-type putting strokes, and in particular concerns a training device which guides the shaft of a putter along a proper path such that the arms of the golfer as well as the club follow a natural pendulum motion path and hand-eye coordination is developed through the duplication of swinging the club through the stroke. Moreover, the device is portable, light in weight and reversible for use either by left-handed or right-handed golfers.

In accordance with the invention, I provide a frame having a base portion for contact with the ground and two upright portions which support an elongated guide member spaced from the ground for sliding contact with the back of a putter shaft as the club is moved through a putting stroke. The guide member is elongated and includes a straight forward section as well as a rearward section which is curved in a gentle arc.

In use, the golfer stands in an area behind the guide member and places the back side of the putter shaft in contact with the guide member in such a fashion that the head of the club is directly adjacent the ground. The user then slides the putter through repetitive putting strokes which include a back swing portion, down swing portion and a follow-through portion while keeping the back of the putter shaft in continuous sliding engagement with the guide member.

The putter during rearward movement through the back swing portion slides along a portion of the straight guide member section as well as the curved, rearward guide member section which is of a configuration for enabling the arms of the golfer to swing in natural, pendulum motion as the body is slightly turned without substantially increasing or decreasing the distance of the club head from the body. As the putter is then moved through its forward stroke, the club again slides along the curved rearward section and then moves in a straight path along the forward section through a target area which is located directly in front of the golfer and approximately in the center of the guide member. If desired, a ball may be placed on the ground in the target area, or alternatively the club may be repetitively moved along its stroke path without the use of a ball.

Repeated use of my training device quickly improves a golfer's putting stroke since the club and therefore the arms are consistently guided along an accurate path for proper pendulum motion and the user readily develops a sense for the proper muscular movement necessary to repeat and duplicate the pendulum motion. Moreover, coordination of the hands with the eyes is readily developed, especially when a golf ball is placed in the target area for impact with the club head as the putter is moved along its swing path.

In preferred forms of the invention, the guide member has an overall, generally C-shaped configuration and is pivotally connected to the frame for adjustment to any one of a number of different inclinations relative to vertical in accordance with the distance that the golfer normally stands away from the ball. If, for example, the user normally assumes a position relatively close to the ball, the guide member may be shifted toward an angular disposition relatively close to vertical so that the straight section as well as the curved, rear section of the guide member are brought in close to the user and the club is thereby retained at approximately the same distance away from the body as the putter moves through the back swing path as well as the forward stroke path. On the other hand, if the golfer normally stands a relatively greater distance away from the ball during putting, the guide member may be adjusted to a disposition at an angle somewhat greater from vertical so that, again, the club stays the same distance away from the body during movement along both the straight guide member section and the curved guide member section.

In other embodiments of the invention, the guide member includes a number of matched pairs of indicia which are located in spaced relationship to each other along the length of the guide member. Each matched pair of indicia are of identical colors which are different from the colors of the remaining matched pairs of indicia, and the indicia of each matched pair are disposed at equal distances on opposite sides of a central point or location on the guide member. The indicia are utilized to visually gauge the desired rearwardmost and forwardmost positions of the putter during the stroke, so that the golfer can quickly develop a balanced stroke which includes portions of equal length on opposite sides of the central point of the guide member (which coincides with the target area of the ball).

For example, if a relatively short swing is needed for tapping the ball only a few feet, then the club is brought back to the first indicia behind the central point or target area, and then shifted during the follow-through stroke to the first, matched indicia on the opposite side of the central point. Alternatively, if the ball is to be hit a somewhat greater distance, then the club shaft is moved further rearwardly toward another one of the indicia behind the central point and the club is then brought during its follow-through stroke to the corresponding, matched indicia on the opposite side of the central point. In this manner, the golfer quickly develops a sense for the muscular movement necessary for swinging the club through a balanced stroke.

Advantageously, the frame as well as the guide member are constructed of relatively lightweight, tubular components. In addition to the pivotal connection between the guide member and the upright portions of the frame, the upright portions are pivotally coupled to the base portion of the frame so that the device can be collapsed to a relatively small profile package for transport or storage. Furthermore, the device may be unfolded in reverse fashion for use by left-handed golfers when desired.

DETAILED DESCRIPTION OF THE DRAWINGS

Figure 1:
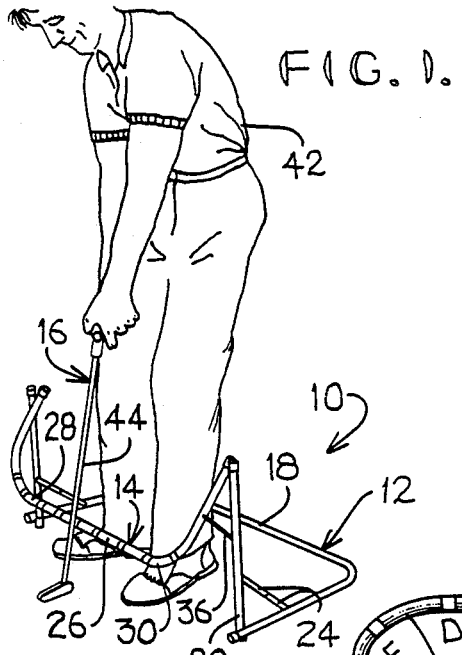
FIG. 1 is a perspective view of a putting stroke training device constructed in accordance with the principles of my present invention, showing a golfer utilizing the device by sliding a putter shaft along the length of a guide member of the device.
Figure 2:
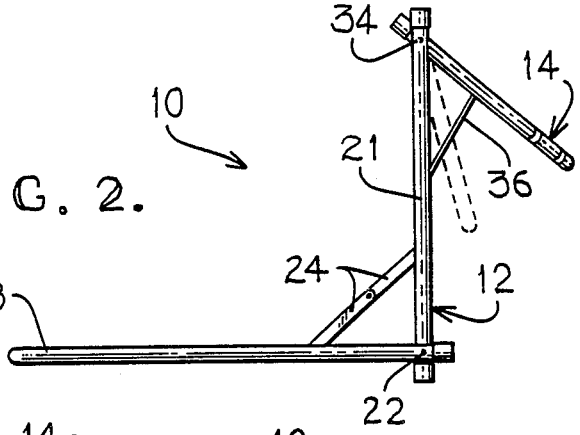
FIG. 2 is an enlarged, side elevational view of the device shown in FIG. 1, illustrating for exemplary purposes two different inclined dispositions of the guide member.
Figure 3:
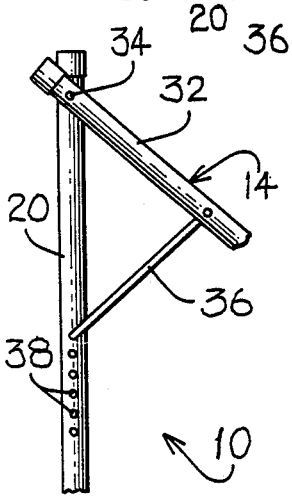
FIG. 3 is an enlarged, fragmentary, side elevational view of an adjustment mechanism for retaining the guide member in any one of a number of inclined dispositions.

A training device in accordance with my invention is illustrated in FIGS. 1–6 and is broadly designated by the numeral 10. In brief, the device includes a frame 12 and an elongated guide member 14 which is supported by the frame 12 in spaced relationship to the ground for guiding a putter 16 (FIG. 1) along a pendulum motion path.

In more detail, the frame 12 comprises an elongated base portion 18 having a generally overall C-shaped configuration adapted for resting contact with the ground. The frame 12 also includes two straight, normally upright portions 20, 21 each of which is swingably interconnected to the base portion 18 by means of a pivot 22 (FIGS. 2 and 4–6) for movement about a horizontal axis. As shown for example in FIG. 2, a pair of pivotally interconnected links 24, 24 are swingably coupled to the base portion 18 as well as each upright portion 20, 21 in order to releasably retain the latter in a vertically extending disposition perpendicular to a plane of reference containing the base portion 18.

The guide member 14 also has a generally overall C-shaped configuration that includes an elongated, substantially straight forward section 26 and a rearward section 28 connected to the forward section 26. The rearward section 28 is curved in an arc which extends around a reference axis that is generally transverse to the longitudinal axis of the forward section 26. The guide member 14 further includes a curved front section 30 integrally connected to the forward section 26, as well as two end portions 32, 32 that are substantially straight and parallel relative to each other.

Preferably, the rearward section 28 of the guide member 14 has a radius of curvature of one foot two inches that gently begins at the adjacent end of the forward section 26 and continues for ten inches when measured in a direction parallel with the length of the forward section 26 until terminating at the adjacent end portion 32. However, good results have also been observed when the radius of curvature of the rearward section 28 is in the range of about one foot to one foot six inches. The forward section 26 extends a distance of eleven inches toward the front section 30 which preferably has a relatively small radius of curvature such as eight inches, whereby the overall length of the guide member 14 in directions parallel with the forward section 26 is on the order of two feet five inches.

Each end portion 32 of the guide member 14 is swingably coupled to an upper region of the corresponding upright portion 20, 21 by means of a pivot 34 for movement about a horizontal axis which is parallel to the axis of pivotal movement of the base portion 18 relative to the upright portions 20, 21 during swinging movement about pivots 22. The guide member 14 is movable about pivots 34 to any one of a number of selected inclined dispositions, and is releasably retained in place by means of a stiff wire brace 36 that is perhaps best illustrated in FIG. 3. An upper end portion of the brace 36 is pivotally connected to the end portion 32 of the guide member 14 adjacent the front section 30, while a lower end of the brace 36 is bent at a 90° angle and extends in a horizontal direction a short distance relative to the overall length of the brace 36.

The lower, bent end of the brace 36 is releasably received in any one of six apertures 38 (FIG. 3) that are spaced along the length of the adjacent upright portion 20. When, for example, the lower end of the brace 36 is placed in the uppermost aperture 38, the guide member 14 lies in a plane which is inclined at a relatively large angle from vertical such as about 40° as is illustrated by the full line depiction of the guide member 14 in FIG. 2. On the other hand, when the lower end of the brace 36 is instead inserted in the lowermost aperture 38, the guide member 14 lies in a reference plane which is inclined at a smaller angle relative to vertical such as about 15° as is indicated by the dashed lines in FIG. 2.

Finally, the guide member 14 preferably includes a plurality of indicia 40 which are spaced along the length of the guide member 14 including the forward section 26, the rearward section 28 and a portion of the front section 30. The indicia 40 are advantageously provided in matched pairs such that the appearance of one matched pair of indicia 40 is different from the appearance of the remaining matched pairs. Furthermore, each of the indicia 40 of the matched pairs are disposed at equal distances apart from a central location or midpoint of the guide member 14 in directions along the length of the latter.

Figure 4:
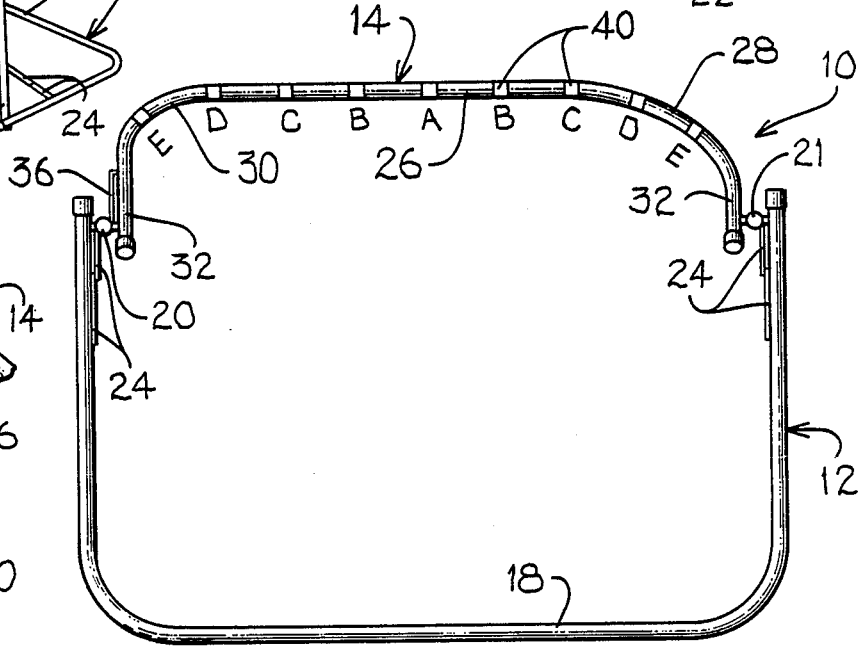
FIG. 4 is an enlarged plan view of the device shown in FIGS. 1–3, depicting among other things matched pairs of indicia which are spaced along the length of the guide member.

Optionally, the matched pairs of indicia 40 are of different color for readily providing a visual indication of the two indicia 40 in any matched pair. Referring to FIG. 4, the indicium 40 designated by the letter A is located at the aforementioned central location, while the two indicia 40 designated by the letter B are of the same color (which is different than the color of the indicium A) and are disposed at equal distances from the indicium A on opposite side of the same. Likewise, the sets of indicia marked by the letters C, D and E each represent matched pairs of different colors which optionally are also different from the colors of indicia A and B, and the indicia 40 of each matched pair are disposed at equal distances from the central indicium A.

Operation

In use, a golfer 42 as shown in FIG. 1 stands in an area which is behind the guide member 14 and which is partially circumscribed by the C-shaped base portion 18 of the frame 12. The putter 16 is then placed over the guide member 14 in such a fashion that the back side of a shaft 44 of the putter 16 comes into contact with the guide member 14 preferably over the indicium 40 marked A.

Next, the golfer 42 takes a few practice shots to observe whether or not the guide member 14 is disposed at a proper inclined orientation in order to establish the correct swing path for guiding the movement of the putter 16. If, for example, the golfer's hand moves away from the body during the back swing of the putting stroke, the angle of inclination of the guide member 14 relative to vertical is too small and the brace 36 should be removed from the aperture 38 in use and instead placed in a higher aperture 38. Alternatively, should the hands move closer toward the body during the back swing portion of the putting stroke, the angle of inclination of the guide member 14 relative to vertical should be reduced and the lower end of the brace 36 should thus be placed in a somewhat lower aperture 38.

In this regard, the angle of inclination of the guide member 14 is determined by the distance that the golfer 42 normally positions the head of the putter 16 away from his or her feet. Consequently, if the golfer 42 typically stands at a relatively close distance to the ball then the angle of inclination of the guide member 14 relative to vertical should be relatively small, whereas if the golfer normally stands at a relatively greater distance from the ball the angle of inclination of the guide member 14 relative to vertical should be somewhat greater. Once the golfer 42 has selected the proper aperture 38, however, the same aperture 38 should be used during subsequent practice sessions unless, of course, the golfer changes his or her stance which results in a corresponding variation of the distance from the golfer's feet to the ball.

During practice strokes, the back side of the putter shaft 44 slides along a path determined by the guide member 14 which includes a portion of the forward section 26 and the curved rearward section 28 during the back swing portion of the stroke, the same portions of the sections 26, 28 during the down swing portion of the stroke and along an additional portion of the forward section 26 during the follow-through portion of the putting stroke. During the follow-through portions of longer strokes, the shaft 44 may extend into the region adjacent the front section 30 of the guide member 14 in an area adjacent the indicia 40 designated E.

The curved rearward section 28 of the guide member 14, in cooperation with the straight forward section 26, ensures that the putter 16 and thereby the arms of the golfer 42 swing in a natural pendulum motion with the shaft 44 of the putter 16 maintained at an equal distance from the body during all portions of the stroke. Additionally, the straight forward section 26 ensures that the head of the putter 12 moves along a straight target line immediately before and after the head makes contact with the ball. Repetitious use of the device 10 will quickly enable the golfer 42 to memorize the appropriate muscular movements necessary for swinging the hands and thereby the putter 16 in a natural pendulum motion.

The indicia 40 are useful for developing a balanced stroke wherein the arc of backswing movement is equal to the arc of the follow-through swing. By selection of proper color-matched pairs of indicia 40 which are spaced apart from each other a distance to correspond to the desired overall path of travel of the section of the putter shaft 44 sliding along the guide member 14, the golfer 42 can easily ensure that the distance that the shaft 44 is brought away from the target area or center location (designated by the letter A) is equal to the distance that the shaft 44 is moved on the opposite side of the center location during the followthrough stroke. Thus, whether or not the golfer 42 practices a longer putting stroke or a shorter putting stroke, the length of the stroke on each side of the center location can be readily gauged by selection of the proper matched pairs of indicia 40 so that a smooth, balanced putting stroke is quickly attained.

Figure 5:
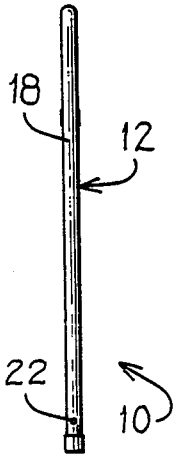
FIG. 5 is a side elevational view of the device shown in FIGS. 1–4 except that the device has been folded to a collapsed orientation for transport or storage.
Figure 6:
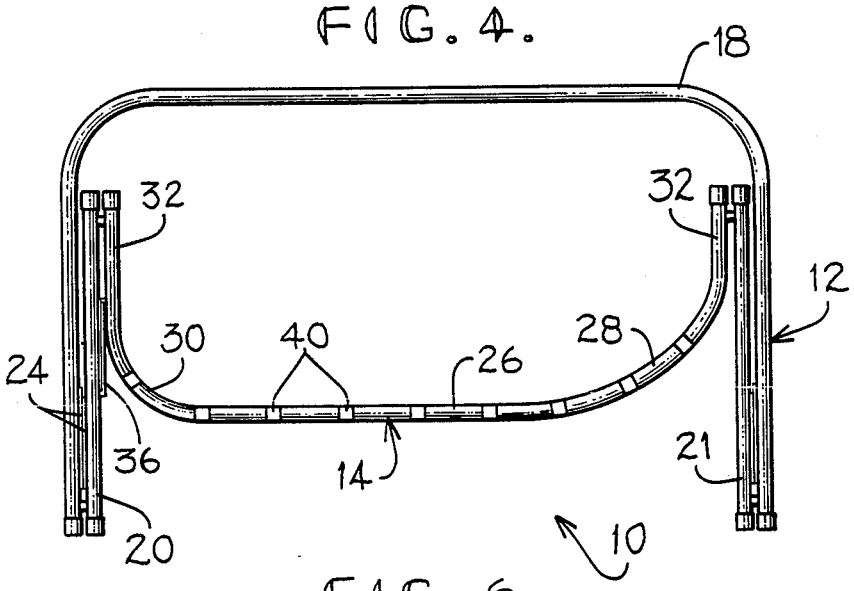
FIG. 6 is a front elevational view of the collapsed device that is shown in FIG. 5.

The device 10 can be collapsed to a relatively small, folded orientation for transport or storage by removing the lower end of the brace 36 from the selected aperture 38, and swinging the guide member 14 about pivots 34 until the guide member 14 lies in a plane passing through the upright portions 20, 21 of the frame 12. Next, the two pairs of links 24 are shifted laterally from their orientation shown in FIG. 2 to enable the base portion 18 to swing about pivots 22 until lying in a vertical plane coincident with the aforementioned reference plane passing through the upright portions 20, 21 and the guide member 14 as depicted in FIGS. 5 and 6.

The device 10 is reversible to an orientation opposite that which is shown in FIGS. 1–6 for use by left-handed golfers. In particular, the base portion 18 of the frame 12 may be swung in a 180° arc relative to the upright portions 20, 21 and the guide member 14 may then be moved in an arc about pivots 34 until located on the opposite side of the upright portions 20, 21 in disposition remote from base portion 18. The lower end of the swingable brace 36 is then inserted in a selected aperture 38 as described above with reference to right-handed golfers. Preferably, the indicia 40 are comprised of bands that circumscribe the guide member 14 so that the indicia 40 may be utilized regardless of whether the device 10 is unfolded for left-handed or right-handed golfers. Moreover, the circular transverse configuration of the guide member 14 enables the putter shaft 44 to smoothly slide along the length of the guide member 14 regardless of the selected angle of inclination of the latter or whether the device 10 is set up for right-handed or left-handed.

Those skilled in the art may recognize that various modifications or additions may be effected to the currently preferred embodiment of my invention without departing from the essence of my contribution to the art. Accordingly, the invention is to be deemed limited only by a fair scope of the claims which follow along with their mechanical equivalents.

I claim:

1. In a practice putting device for use by a golfer holding a golfing putter by the handle thereof for aiding the golfer in developing a pendulum-like putting stroke, the putter having a putter head and a shank portion adjacent thereto, said device comprising:

a frame including a base portion configured for supportive contact with a planar support surface, a pair of elongated, upright, support portions and means pivotally coupling said upright portions with said base for selective, relative, pivotal shifting of said upright portions and said base portion;

a shank portion-engaging guide member presenting a generally C-shaped configuration and presenting a pair of arcuate sections and a straight section for engaging the putter shank portion in order to guide said portion and thereby the putter head along a path defined by said member;

means pivotally coupling said guide member with said upright portions for selective, relative, pivotal shifting of said guide member and said upright portions;

means shiftably coupling said base portion, upright portions, and guide member including means for shifting movement relative to one another for shifting between a storage position in which said base, upright portions, and guide member are pivotally shifted to lie generally in a common plane for compact storage of said device, and a golf practice position in which said shank portion guide member is disposed in a spaced relationship relative to the support surface and in which said guide member defines the sole path for contact with and guiding of the golfing putter shank portion while the golfer holds the handle of the putter; and a plurality of indicia pairs defined on said guide member with the respective indicia of each of said pairs lying equiidistant from and on opposed sides of a center portion defined on said straight section thereby defining the limits of a respective, corresponding plurality of pendulum - like putting strokes.

2. The invention as set forth in claim 1, further including means for connecting said guide member with said frame for selective movement of said guide member about a generally horizontal axis to any selected one of a number of inclined positions relative to a vertical axis.

3. The invention as set forth in claim 2, wherein said frame includes an upright portion interconnecting said guide member and said base portion and including means extending between said upright portion and said guide member for retaining the latter in said selected inclined disposition.

4. The invention as set forth in claim 1; and including releasable means for substantially preventing pivotal movement between said base portion and said upright portion of said frame.

5. The invention as set forth in claim 1, wherein said base portion of said frame has a generally overall C-shaped configuration and co-operates with said guide member to define a user's standing area therebetween.

* * * * *